US005997413A

United States Patent [19]

Wood, IV

[11] Patent Number: 5,997,413

[45] Date of Patent: Dec. 7, 1999

[54] AERODYNAMICALLY MATCHED GOLF CLUBS

[75] Inventor: Chalmers Benedict Wood, IV, P.O. Box 174, North Garden, Va. 22595

[73] Assignee: Chalmers Benedict Wood, IV, Springfield, Va.

[21] Appl. No.: 08/631,101

[22] Filed: Apr. 12, 1996

Related U.S. Application Data

[60] Provisional application No. 60/010,903, Jan. 31, 1996.

[51] Int. Cl.[6] ..... A63B 53/04

[52] U.S. Cl. ..... 473/327; 473/328

[58] Field of Search ..... 473/327, 345, 473/346, 341, 349, 219, 226, 282, 290, 291, 292, 328

[56] References Cited

U.S. PATENT DOCUMENTS

| | | | |
|---|---|---|---|
| 1,253,700 | 1/1918 | McLaughlin | 473/288 |
| 1,396,470 | 11/1921 | Taylor | 473/317 |
| 1,587,758 | 6/1926 | Charavay | 473/327 |
| 2,083,189 | 6/1937 | Crooker | 473/327 |
| 2,088,095 | 7/1937 | Sargent | 473/327 |
| 3,368,812 | 2/1968 | Baldwin | 473/288 |
| 3,595,577 | 7/1971 | Hodge | 473/327 |
| 4,023,802 | 5/1977 | Jepson | 473/327 |
| 4,809,983 | 3/1989 | Langert | 473/327 |
| 5,301,941 | 4/1994 | Allen | 473/327 |
| 5,460,371 | 10/1995 | Takeda | 473/345 |

*Primary Examiner*—Sebastiano Passaniti

*Attorney, Agent, or Firm*—Armstrong, Westerman, Hattori, McLeland & Naughton

[57] ABSTRACT

A golf clubhead has been multi-angularly streamlined so that it presents reduced aerodynamic drag when swung throughout the entire 120 degrees prior to impact with a golf ball. During this portion of the swing, golfers typically rotate their golf club about the axis of its shaft by up to 135 degrees. During the 120 degrees of swing prior to ball impact, the club is typically accelerated from about 50 MPH to 100 MPH or more. The streamline shape is developed for higher efficiency for air flow encountered at the high speed portion of the swing arc at the expense of reduced streamline efficiency during the slower portion of the swing. The shapes herein conform to U.S.G.A. rules. Allowance is also made in the streamline shape for the non-radial sweep of the shaft during the earlier portion of the swing. In the preferred embodiment, a high strength faceplate is fitted to a low density aerodynamic fairing thereby creating a clubhead combination with a center-of-mass close to the plane of impact. The club shaft is preferably fitted to an extension of this faceplate. Test clubs have exhibited increased driving distance and increased accuracy, believed to be due to higher club speed and reduced perturbation of the club path by air turbulence.

5 Claims, 12 Drawing Sheets

ROTATION OF CLUB HEAD AROUND SHAFT AXIS DURING THE LAST 90 DEGREES OF CLUB SWING TO IMPACT WITH BALL.

ABOVE VIEWS ARE LOOKING DOWN UPON CLUBHEADS DURING THE FINAL 90 DEGREES PRIOR TO IMPACT. CLUB HEADS ARE SEEN FROM ABOVE LOOKING THROUGH SHAFT AXIS TO SHOW ROTATION AS THE CLUB APPROACHES IMPACT.

AERODYNAMICALLY MATCHED GOLF CLUBS

This utility patent application was preceded by Disclosure Document No. 389,109 filed Jan. 3, 1996, and Provisional Application No. 60/010,903 filed Jan. 31, 1996.

BACKGROUND OF THE INVENTION

1. Technical Field

This invention relates to golf clubs. It further relates to the aerodynamic shaping of the head of a golf club. It relates still further to an aerodynamically streamlined golf club made by the combination of a faceplate fixed to an aerodynamic fairing.

2. Description of the Prior Art

Golfe' is noted in a decree of the Scottish parliament under James II dated March 1457 at which time people seemed to be playing too much golf at the expense of their skill at bowemerkis (archery). In 1471, another decree under James III was passed to discourage golfe and futeball and in 1491 King James IV issued a decree with pains and penalties attached wherein "Futeball and Golfe Forbidden" because he decided it was degrading Scotland's level of defense preparedness against the threat of invasion by England. Shortly afterwards, James IV shifted his defense budget from the Bowers Guild to the Alchemists and the fire arms makers, and then legalized golf once again so that the suddenly unemployed Bowers could now make and sell golf clubs and support their families.

Throughout five centuries of recorded golf history, one reads of occasional conflict, usually driven by social or technological forces independent of the game. A current minor example of conflict in golf equipment utility can be found in the needs and desires of manufacturers to generate profits in juxtaposition to the desire of golf's regulating bodies to maintain the game. The development of new golf equipment has been slow during the 20th century as most of the world's scientists and engineers have taken defense related research jobs. Industries such as golf whose products relate to leisure have been unable to compete as the brightest people were employed elsewhere while leisure equipment has been left behind.

Golf clubs, to be allowed for use in tournament and competition play, must conform to the rules of The United States Golf Association (U.S.G.A.) founded in 1894 and The Royal and Ancients Golf Club (R & A, and also known as the R.A.G.C.) of St. Andrews, Scotland founded in 1754. These two groups together form the traditional regulating body governing the rules of golf and its equipment. In this capacity, the U.S.G.A. and the R & A will on occasion accept an advance in science or technology and permit the application of such to the making of a change in club or ball manufacture when in their judgement they believe such change will benefit the spirit and traditions and customs of golf.

Notable changes brought on by technology are illustrated by the development of the golf ball. The earliest known ball was the "feather", a hatful of feathers packed into a sewn up leather cover. The best player could hit a feather about 150 yards. In 1848, the "guttie" was introduced, a smooth ball made of rubbery gutta-percha which could be hit about 195 yards. A new guttie would duck and twist erratically in flight but performed better and better as it became scarred and rough. It was accordingly modified by players to make it rough and then by manufacturers who added dimples that made the flight path more predictable. In 1898, a rubber cored ball was introduced that gave a more precise trajectory than the guttie and could be hit about 255 yards by a good player. The rubber ball was more reliable in play, the guttie having had the perplexing tendency to fly into several pieces when played.

To limit the ingenuity of golf ball manufacturers, the U.S.G.A. introduced a machine in 1941 to automatically play the ball. A ball at a temperature of 23 +/−1 degree C. must not leave the machine at greater than 250 feet per second. The average distance a ball will travel in carry and roll, when driven by a standardized machine, is now limited to 280 yards.

Not all technical "improvements" have been acceptable. Several manufacturers marketed recently a new golf ball that once again improved the range obtainable with a normal drive. On this occasion, the regulating bodies judged it to be not in the best interests of the traditions and nature of golf and determined that the new ball does not conform to the rules.

Golf clubs have gone through a similar technical transition. The earliest known clubs had a wooden head fitted to a wooden shaft. In 1929, use of the steel shaft was sanctioned by the R.A.G.C. and the U.S.G.A. The head of the "wood" was then changed to a hollow steel shell, and now is permitted in a variety of metals as well as fiber reinforced plastic, the core frequently being filled with a foam plastic. The shaft may also be composed of a fiber reinforced plastic composite.

In the area of aerodynamics as applied to the golf club, some research has been done and several patents have been granted for clubs claimed to have reduced aerodynamic drag whereby the golfer can attain increased swing speed and an increased distance for the golf ball. U.S. Pat. No. 5,190,289 by Nagai et al describes the use of a wind tunnel to measure drag on a golf club. Factors such as lift and pitching moment were not mentioned however and the improvement in performance was cited as 3%.

Air resistance and drag is mentioned in U.S. Pat. No. 5,398,935 by Katayama which shows an aerodynamic shape, but does not address the changing forces as the clubhead rotates.

Iriarte in U.S. Pat. No. 5,435,558 shows a design with two channels as cavities that direct the airflow alongside the clubhead to give stabilization and minimize undesired vibration.

Davis et al in U.S. Pat. No. 5,318,297 add airfoils to stabilize and smooth out airflows on a clubhead, but in no manner would the inventions of Iriarte or Davis et al conform to the U.S.G.A. rules as they are now interpreted.

In U.S. Pat. No. 5,092,599 Okumoto et al show a spoiler on the clubhead that distorts and changes the airflow on the clubhead, but for only one specified direction of club motion.

In U.S. Pat. No. 2,447,967, Stone covered the problem of the different characteristics between the two types of clubs known as "woods" and "irons", and he attempts to improve upon this ergonomic and aerodynamic problem. His solution is based upon vibration, mechanical commonality, visual factors, and materials available. The result was a slight improvement in the aerodynamic lift characteristics of his club set.

No prior art was found regarding the problem of air flow over the clubhead as the club rotates, during a golfer's swing, about the longitudinal axis of the shaft.

The Wright brothers historic flight in 1903 and their subsequent patent showed the principle of aerodynamic lift forces through their careful study of aerodynamics as it could be applied to the shape, form, and fashion of their invention. These aerodynamic forces now affect a considerable portion of mankinds' activity and yet they are not yet utilized in the design of golf clubs.

In this invention, two aerodynamic problems of woods golf clubs were studied. The first of these problems is that of "lift" or "dive force acting on the club. In a series of tests run at Georgia Institute of Technology, School of Aerospace Engineering in their Low Turbulence Wind Tunnel, it was found that a Spalding 2 wood generated 0.144 pounds of lift directed along the axis of the shaft towards the grip at a freestream air speed of 70 feet per second flowing perpendicular to the clubface. This velocity is approximately 40% of that achieved by the professional golfer so the lift force in actual use of a club is over five times this value or approximately 0.75 pounds. Similar tests made on a Wilson 4 iron showed 0.27 pounds of lift, corresponding to approximately 1.35 pounds lift at peak swing speed.

Tests comparing other woods and irons have shown that most irons exhibit a diving force while typical woods exhibits a lifting force. This strong difference between woods and irons can of course confuse the casual golfer as he switches between say a five wood and a number one iron. The difference between the wood and the iron is really only controllable by the dedicated or professional golfer who practices driving and plays golf often enough to learn how to compensate for the differing eccentricities between his clubs.

A second aerodynamic problem occurs in golf clubs. This is that during the common golf swing of a wood or an iron, the club shaft is rotated by 90 degrees or more and in many cases as much as 135 degrees about its longitudinal axis during the 90 degrees of swing prior to striking the ball. During this same portion of the swing, the club is accelerated from approximately 65 miles per hour (MPH) to over 100 MPH, and in the case of a professional golfer, to as high as 140 MPH. Add to this the fact that golf is frequently carried on when winds or wind gusts may exceed 30 MPH, this velocity being added or subtracted from the swing velocity according to the direction of ambient wind past the golfer.

This means that airflow over the club flows from the heel to the toe when the shaft is horizontal (at 90 degrees prior to impact) and has shifted to flow from the face to the back of the clubhead when the club is reaching impact.

Another factor to consider in a study of aerodynamic effects on the clubhead is that a blunt clubhead will generate von Karman vortices behind it when traveling at these speeds. Such vortices grow in size and follow behind the clubhead, then break away only to be immediately followed by growth of a new vortex of opposite rotational direction which repeats the process.

The problem with such vortices is twofold. First, the alternating vortices create an oscillating force on the body which is generally perpendicular to the direction of air flow and which may equal or even exceed the magnitude of the previously mentioned lift forces. In this case the oscillating force will operate in the same direction as the maximum component of the lift/dive forces. Such an oscillating force on the clubhead when it is only supported by a limber shaft can cause it to deviate from its non-perturbed flight path and cause a poor shot or even a miss altogether.

The second problem is that these vortices indicate that a high drag factor is operating. Such drag of course will decrease club speed and diminish the distance obtained with the ball.

SUMMARY AND OBJECTS OF THE INVENTION

This invention concerns golf clubs of the type known as woods and also the type known as irons, and concerns the shaping of the head of such clubs. Woods have generally had a shape that appears almost streamlined, but in fact, they do not perform well when put in a wind tunnel.

I have developed a series of shapes for the wood however and presented them to the United States Golfing Association to determine if they conform to their Rules of Golf. After considerable study, they have provided me with a statement that the shape which I describe herein (and a derivative of it which I also include in this patent specification) conforms with Rules of Golf: Rule d. "Clubhead" under 4-1. "Form and Make of Clubs".

The conforming shape is such that it presents a reasonably streamlined section throughout the rotation of the longitudinal axis of the club shaft through 135 degrees prior to the point of the club face striking the ball square on. The multi-angular streamlining obtained is a large improvement over the bluff body shape of a conventional clubhead, thereby nearly eliminating the 'lift' force on the head. The streamlining also reduces the strength of vortex generation and the associated oscillating forces on the clubhead to a negligible level.

To achieve mass balance in the clubhead, a multi-piece head is used. A faceplate made of a high strength material such as steel, aluminum, or titanium provides weight in the front of the head while further weighting can be provided near the toe and heel of the faceplate or under the faceplate to increase the polar moment of inertia of the clubhead. A fairing of low density material such as persimmon wood or plastic can also be hollowed out to reduce its central mass and further increase the polar moment of inertia.

To increase the strength of the junction between shaft and head, which becomes narrow in this aerodynamic design, the shaft is preferably attached directly to the faceplate while the fairing then becomes merely an aerodynamic guide and mechanical balance.

Best use may be made of the invention if it is applied to a set of woods ranging say from a number one to a number seven. The shaping can be varied smoothly so that the first standard iron used will have aerodynamic characteristics not too different from the high or seven wood. Then as the golfer switches from wood to iron, or vice versa, he will not be surprised by an abrupt transition in swing as exists with conventional clubs.

The objects of this invention are therefore to provide an aerodynamically shaped golf club that exhibits neutral swing characteristics, is not adversely affected by aerodynamic lift or dive force, does not flutter from the generation of von Karman vortices, and can be accurately swung in windy conditions with roughly the same feel as when swung in still air. As a benefit of the aerodynamic shaping the clubhead has less air drag and can therefore be swung at higher speed during the swing, and imparts more impact and distance to the ball.

The success of the golf club was demonstrated when on Feb. 13, 1996 two skilled golfers, Messrs. Simon Cooke and Timothy Cooke of the University of Virginia Golf Team, tested a group of Wood's Aerodynamically Matched Golf Clubs and compared them to their own clubs.

In these tests run on a driving range at Keswick Country Club of Albemarle County, Virginia the Cooke brothers were able to consistently, unerringly, and repeatedly drive balls beyond the far flag on the range and within a width of plus or minus 3 yards which was on average 10 yards further than they had just previously demonstrated with their professional Callaway Big Bertha clubs.

Greater accuracy is achieved by the reduction in turbulence about and behind the body of the streamlined Wood's clubhead. Such turbulence is found behind a bluff body of the approximate size of a golf clubhead when it is subjected to air flow at speeds greater than about 50 miles per hour. This reduced turbulence means that less aerodynamic force is generated to deflect the body from the smooth path impressed on it by the golfer. With less tendency to generate turbulence, the club position is determined more by the golfer's input and guidance and less by the vagaries of random air turbulence and wind currents past the golfer's feet at the time of his stroke.

In summary, it is concluded that multi-angular streamlining results in greater attainable velocity and greater accuracy in the Wood's clubhead, both of which qualities allow the golfer to achieve better scores.

BRIEF DESCRIPTION OF THE DRAWING FIGURES

Figure 6:
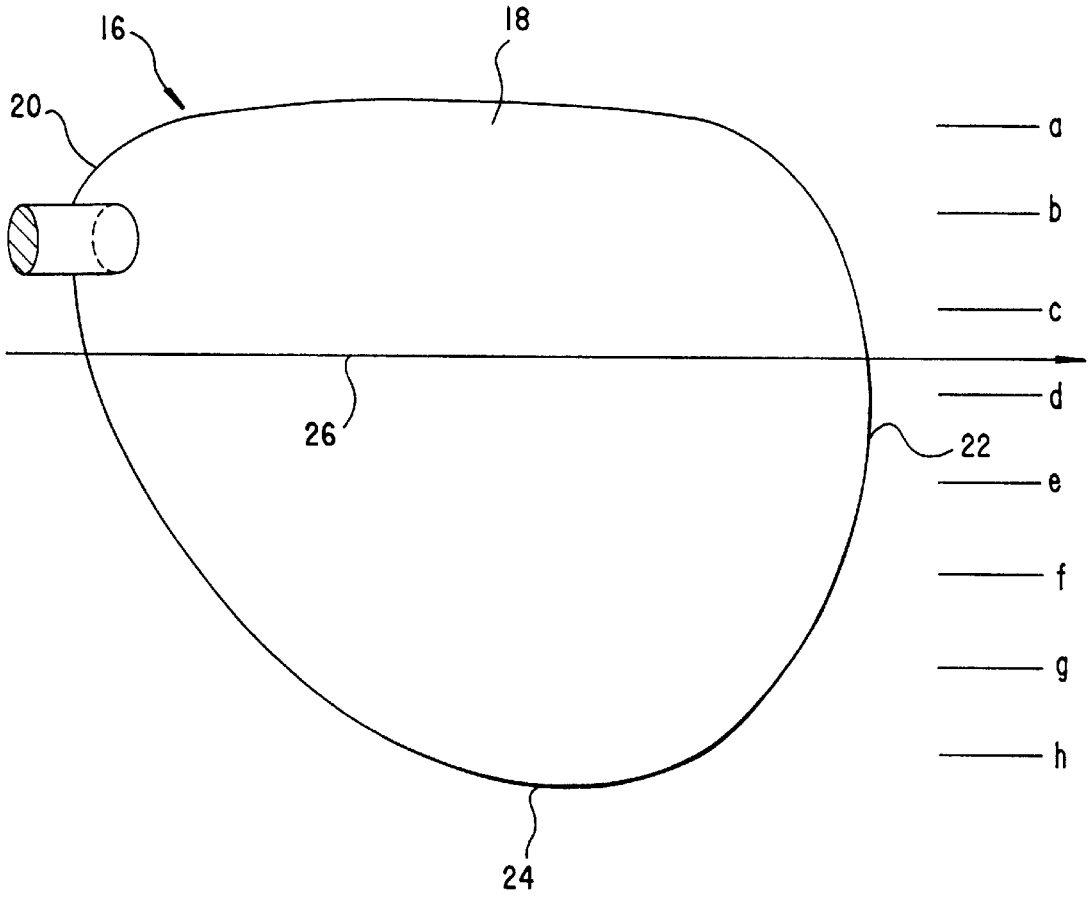
FIG. 6 is an elevational view of the golf clubhead at position 1 of FIG. 5.
Figures 7A, 7B, 7C, 7D, 7E, 7F, 7G, 7H:
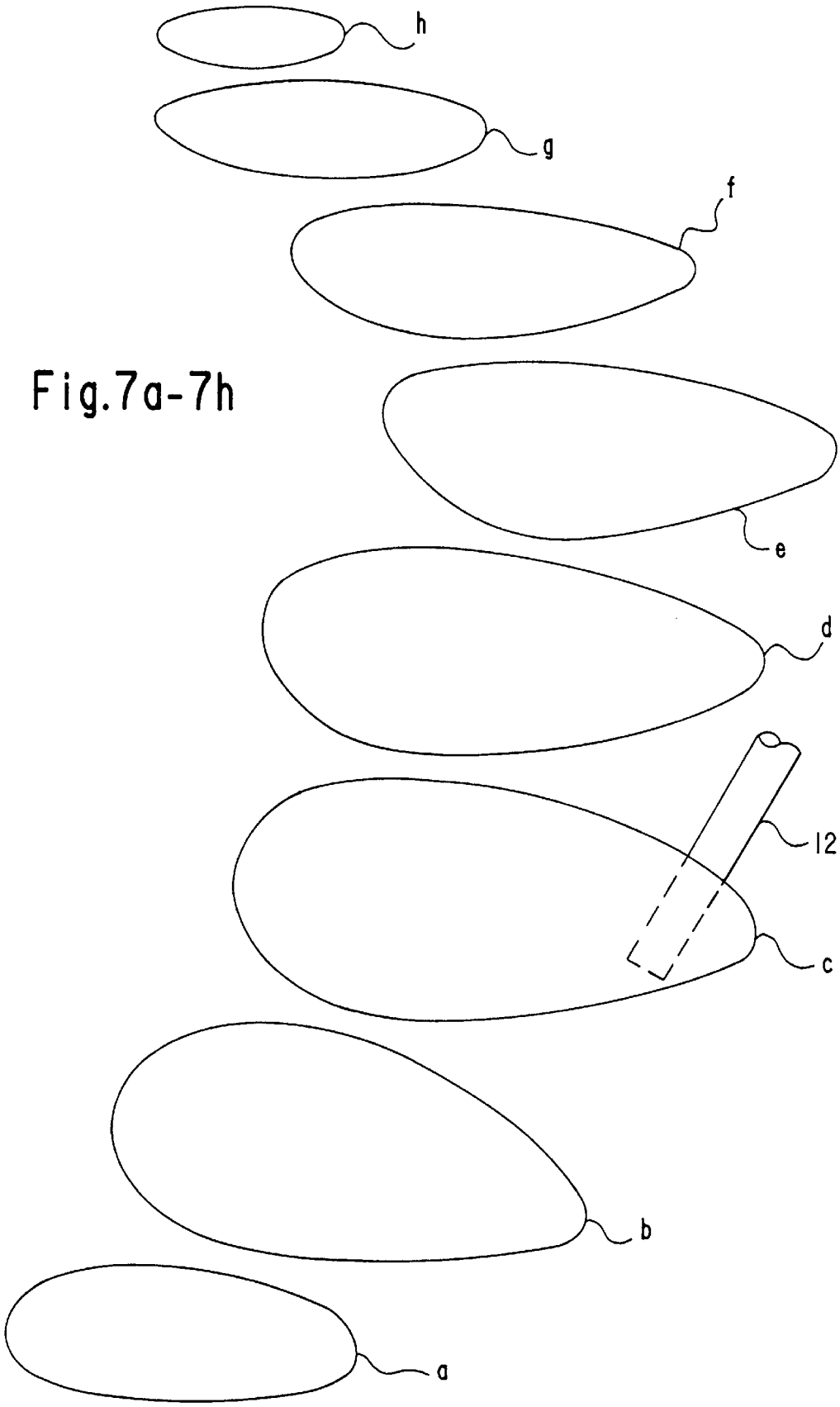

FIGS. 7*a* through 7*h* illustrates sectional outlines of the clubhead in FIG. 6 progressing from the face to the back of the clubhead.

Figure 5:
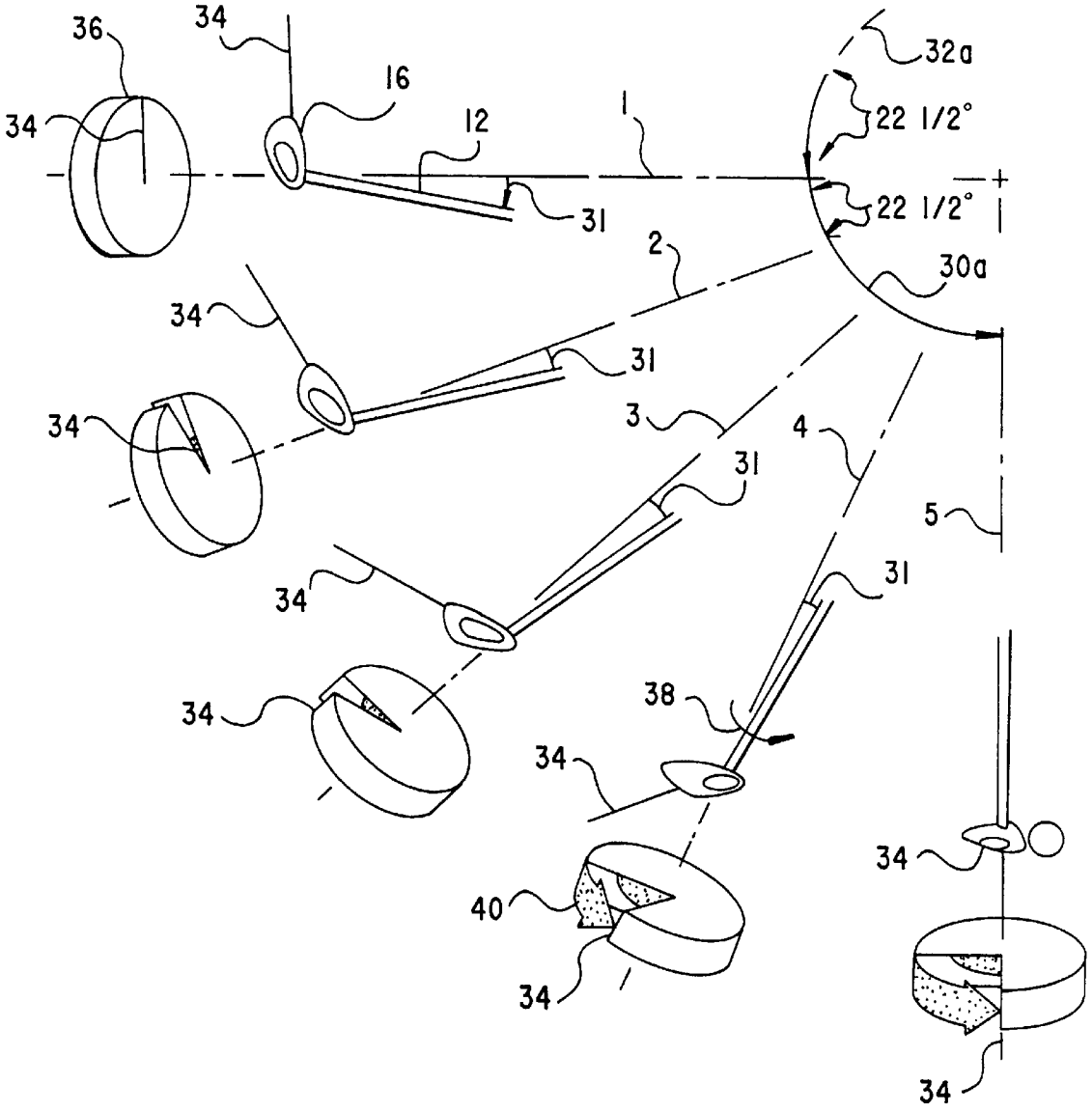
FIG. 5 is a multiple exposure front elevational view of a golf club taken during a portion of a swing, illustrating rotation of the club about the axis of the shaft.
Figure 8:
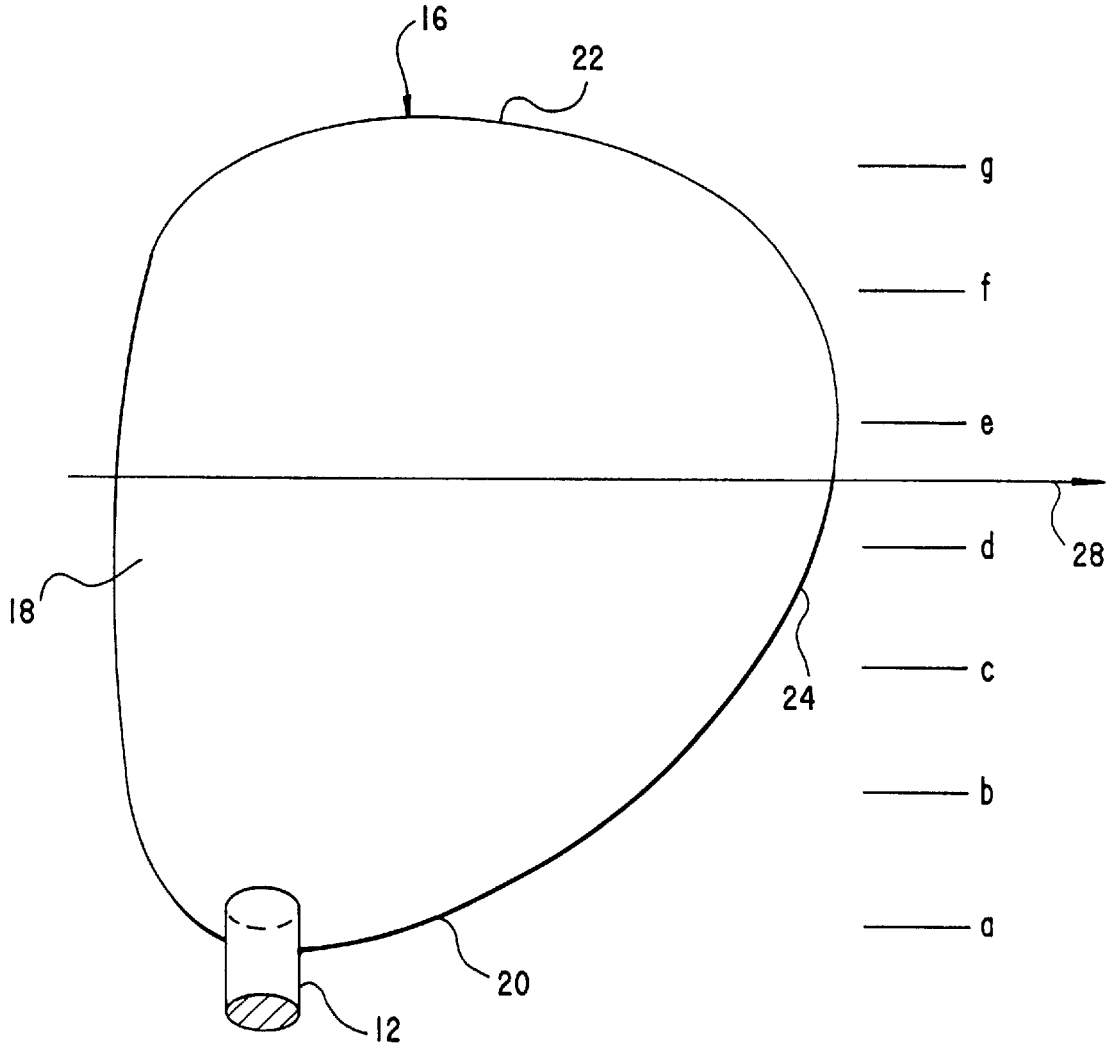
Figures 9A, 9B, 9C, 9D, 9E, 9F, 9G:
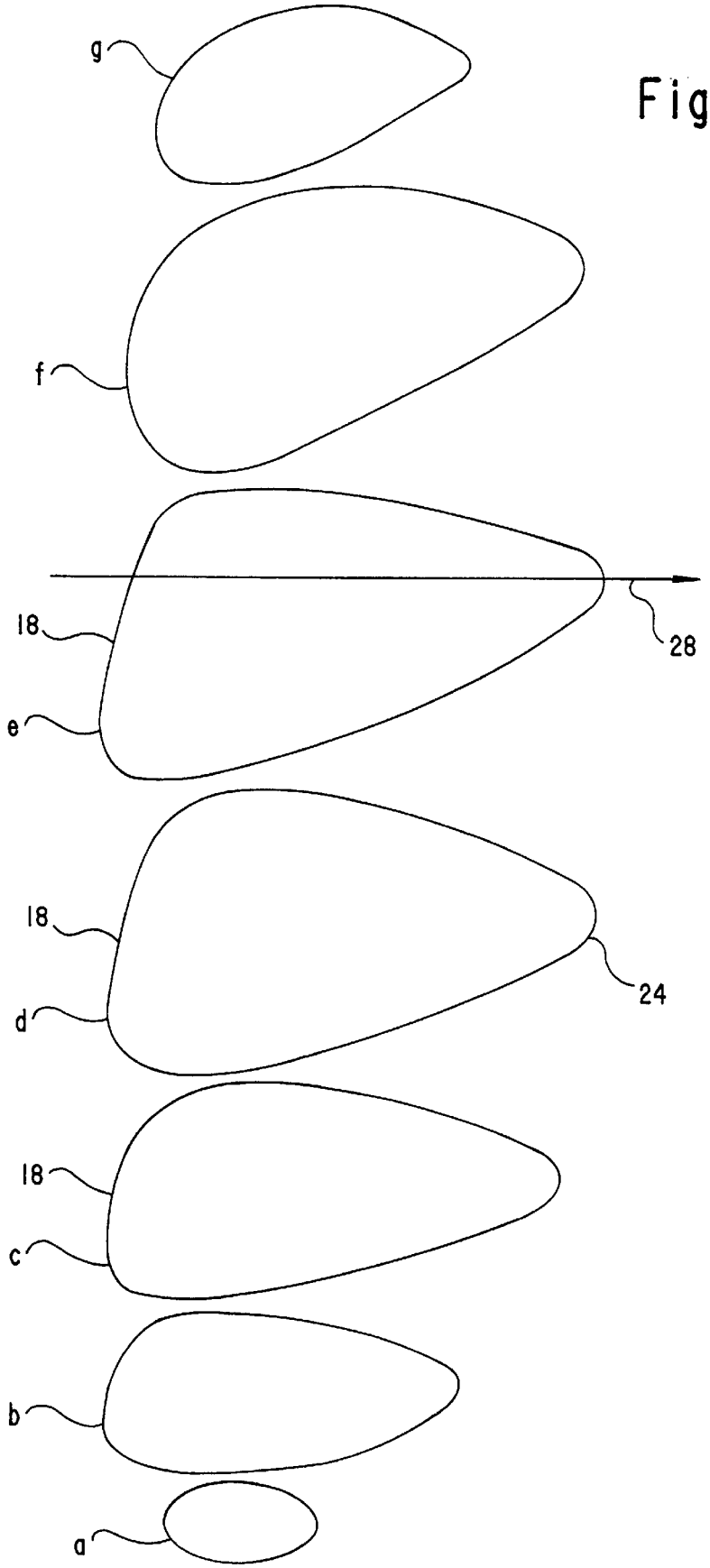

FIG. 8 is an elevational view of the golf clubhead at position 5 of FIG. 5, just at the instant of impact with the ball.

FIGS. 9*a* through 9*g* illustrates sectional outlines of the clubhead in FIG. 8 progressing from the heel to the toe of the clubhead.

Figure 10:
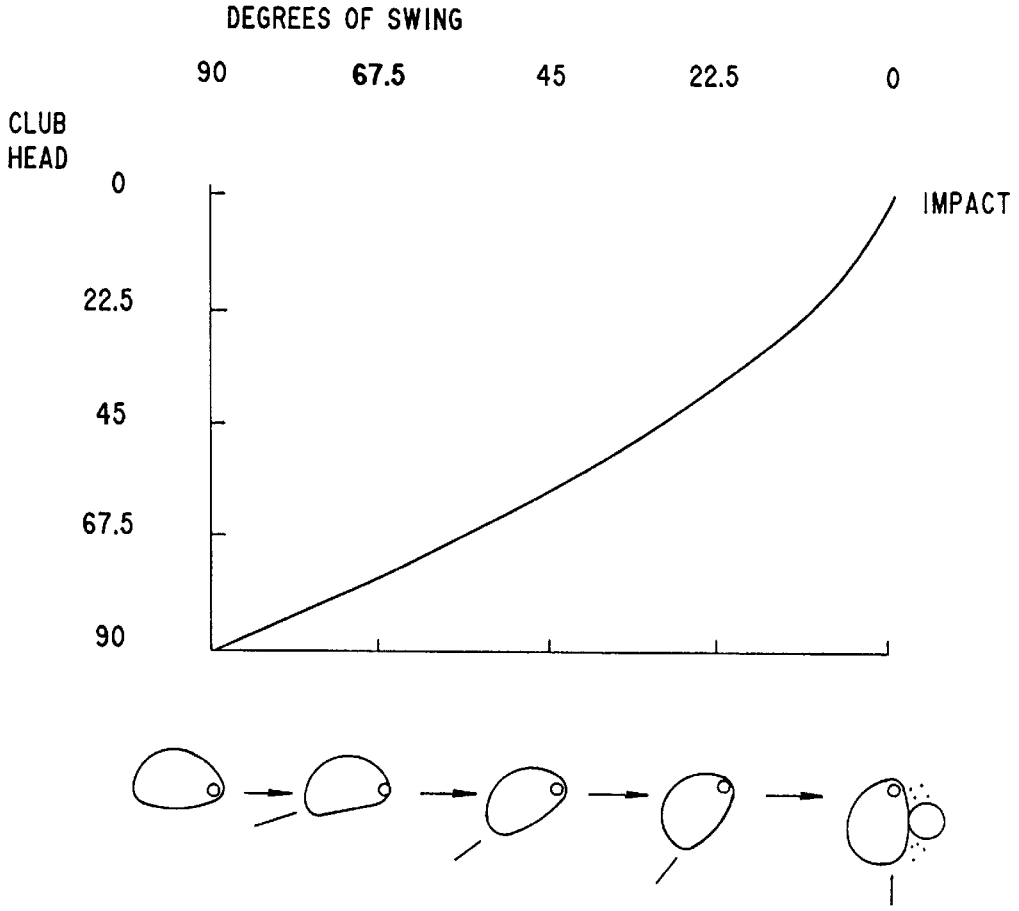

FIG. 10 is a graph illustrating club shaft rotation as a function of club swing angle.

Figure 11:
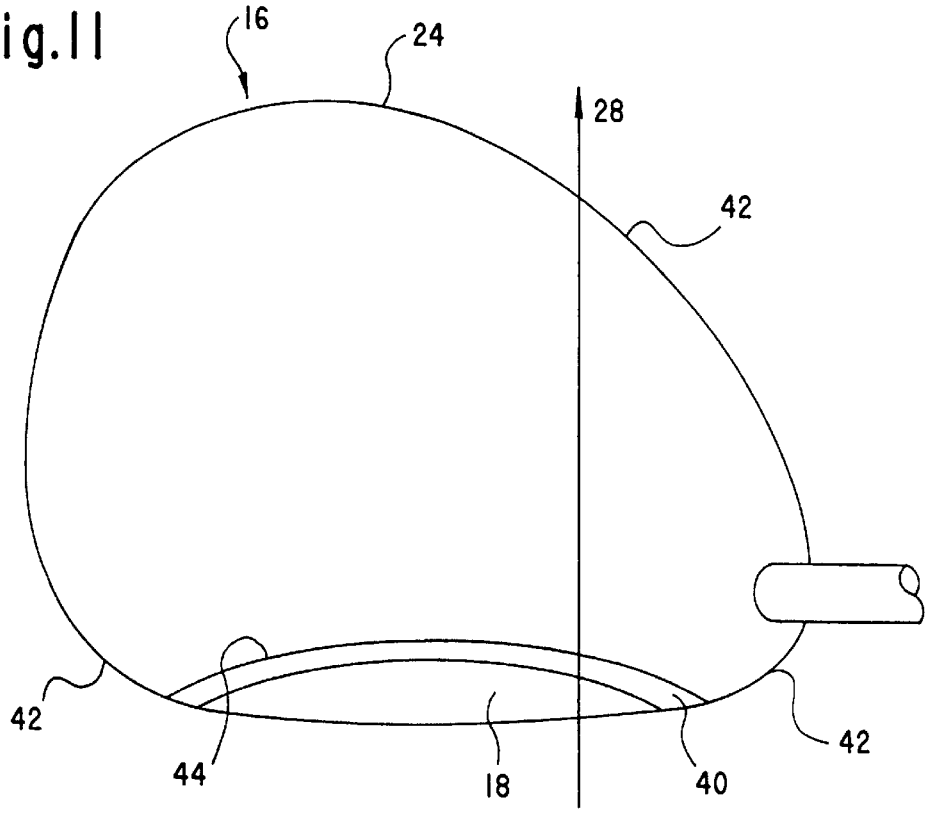

FIG. 11 is an elevational view of an aerodynamic golf clubhead with inset faceplate.

Figure 12:
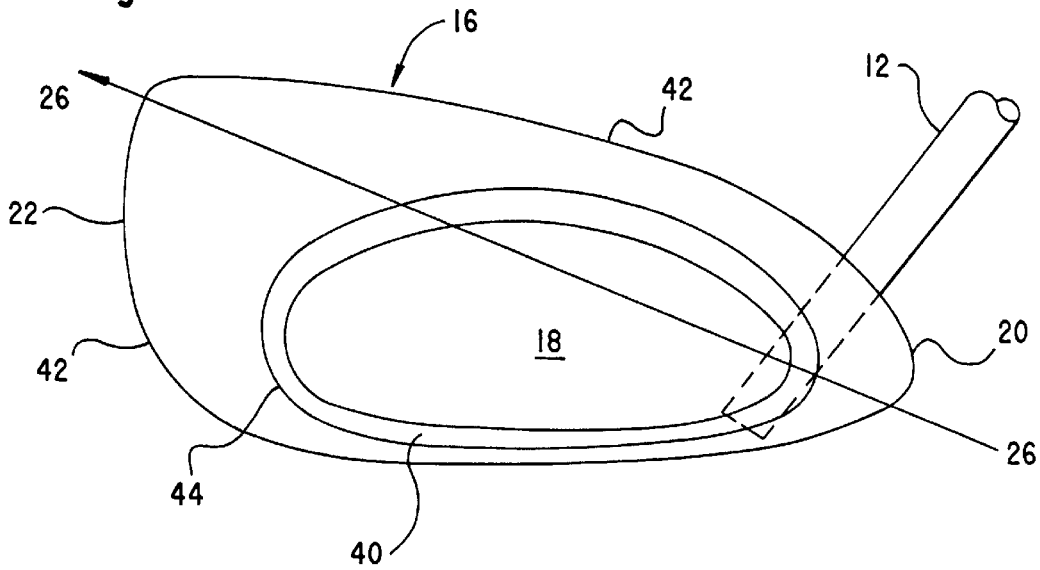

FIG. 12 is a front elevational view of the clubhead of FIG. 11.

Figure 13:
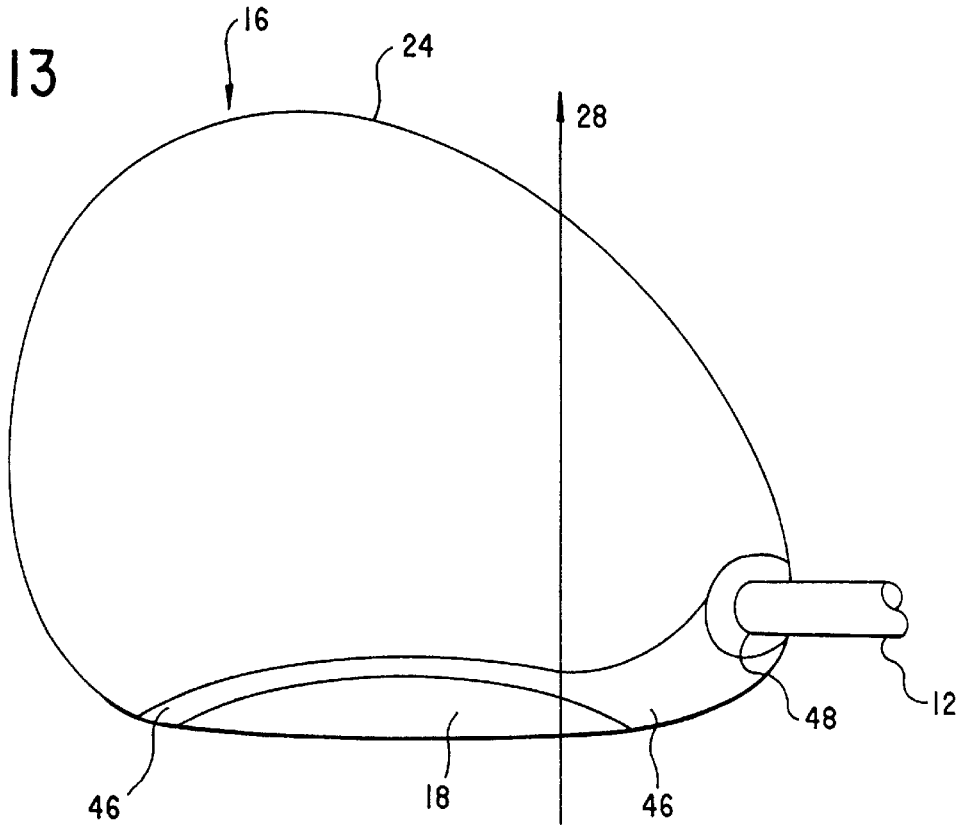

FIG. 13 is an elevational view of a golf clubhead with attached faceplate wherein the faceplate contains connection means for the club shaft.

Figure 14:
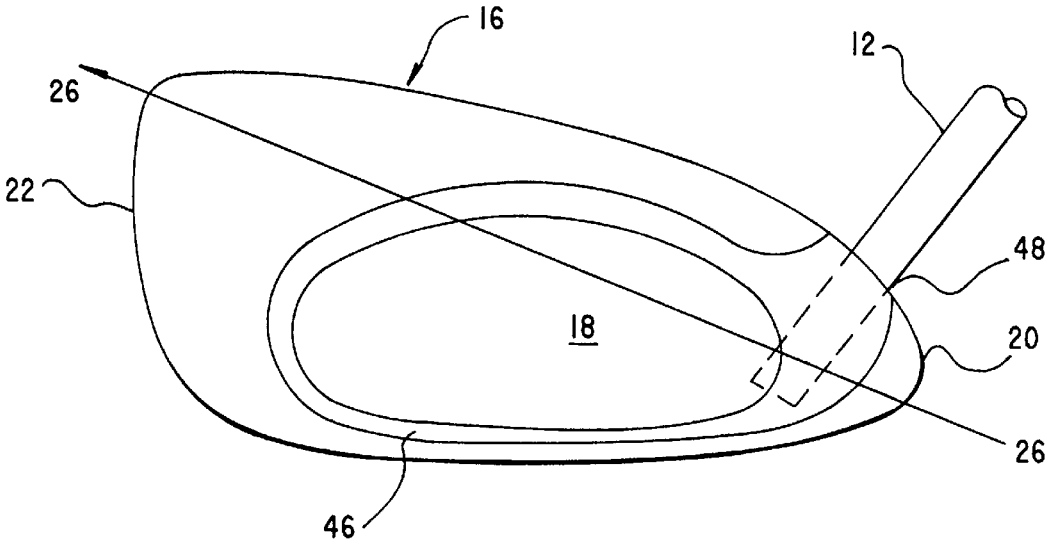

FIG. 14 is a front elevational view of the clubhead of FIG. 13.

Figure 15:
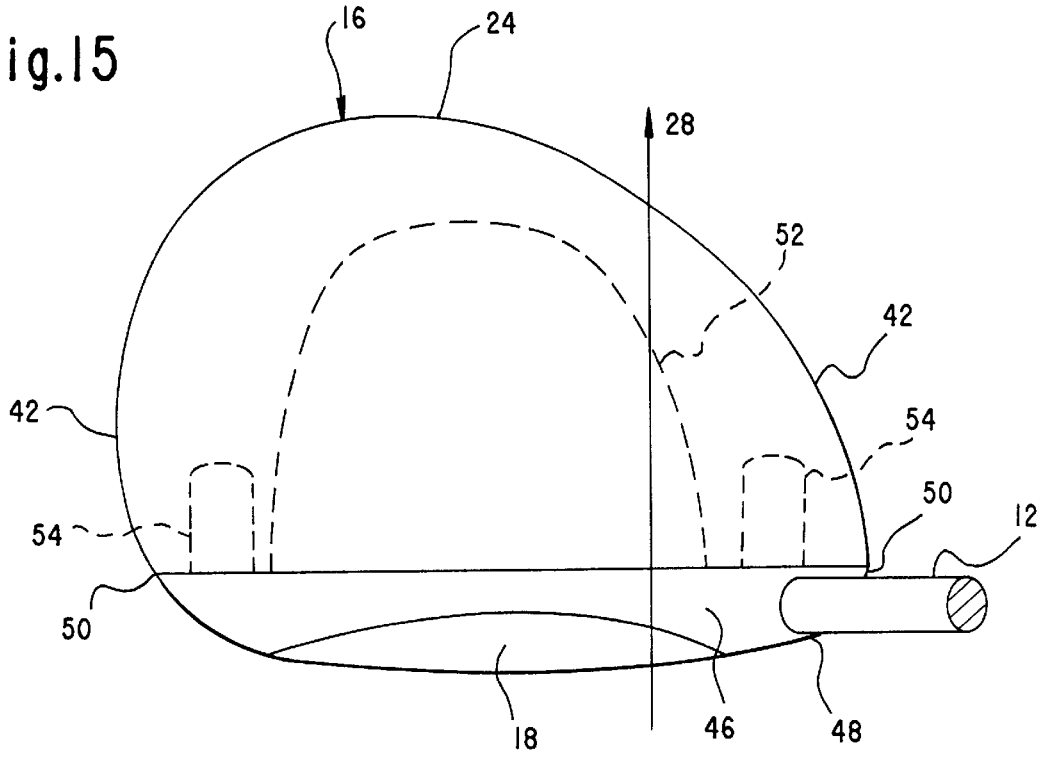

FIG. 15 is a front elevational view of another aerodynamic clubhead having attached faceplate with shaft attached to the faceplate.

Figure 16:
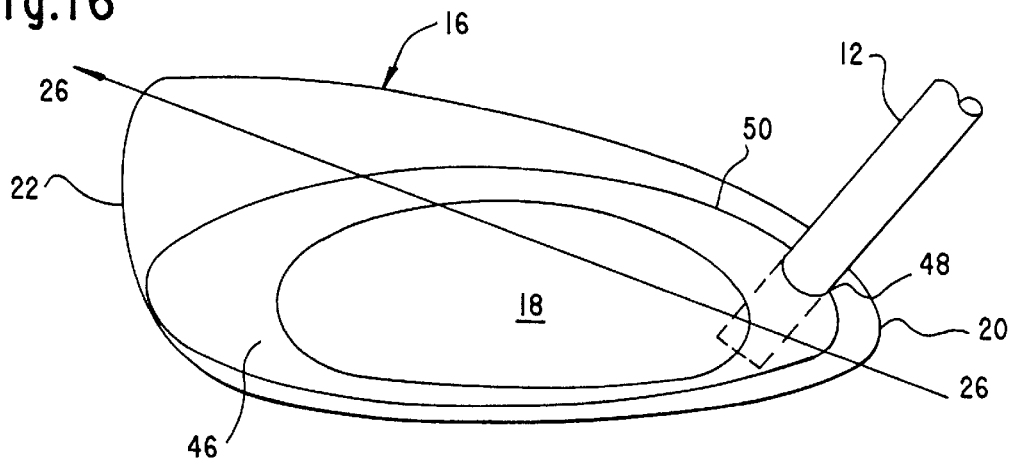

FIG. 16 is a front elevational view of the clubhead of FIG. 15.

Figure 17:
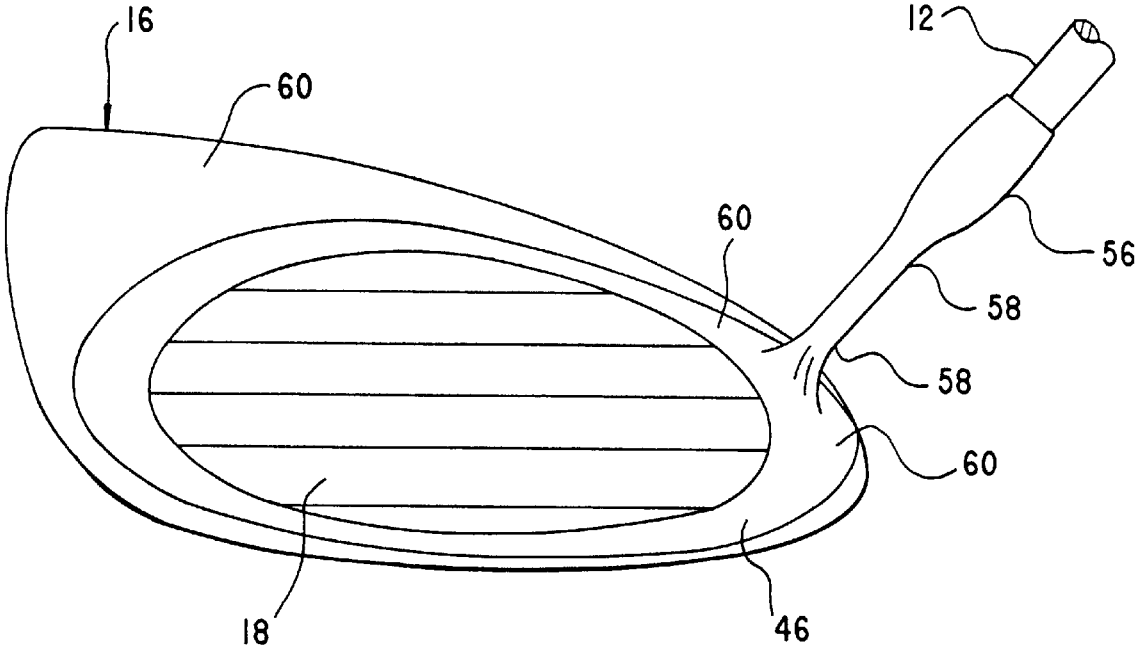

FIG. 17 is a front elevational view of a clubhead having a necked down hozel integral with the faceplate.

DETAILED DESCRIPTION OF THE PREFERRED EMBODIMENTS

A slow motion study, by high speed multiple exposure photography or videography, reveals that the typical golfer rotates the shaft of his club during his swing. This rotation is particularly evident for long range clubs such as low number irons and woods. The number one wood is the most susceptible to such rotation when a golfer is striving to obtain maximum range from a drive, a normal drive from the tee of most par four, par five or par six holes. This rotation is generally in the range of 90 to 135 degrees about the longitudinal axis of the club shaft and it occurs primarily during the last 90 degrees of club swing prior to clubhead impact with the ball.

The clubhead should therefore be streamlined for the multi-angular flow since the flow direction sweeps as much as 135 degrees angle during the swing. The streamlining must be compromised somewhat for any specific angle in order to be generally effective over such a wide angular range. The streamlining emphasis is easily defined however since we know that the club attains maximum velocity (from face to back) when the club face has become perpendicular to the tangential motion of the club at the moment of impact with the ball, and the streamlining should be best for the high speed flow at that angle. At 90 to 135 degrees back from that flow direction, namely when the flow is from heel to toe, the streamline shape may be much less perfect because air speed in that direction is only 60% of maximum, and dynamic air pressure is only 36% of maximum.

The combination of high air velocity across the club and the additional ambient and random air currents or winds that may occur while the golfer is addressing the ball generate aerodynamic forces on the clubhead on the order of one to two pounds magnitude, such force being sufficient to appreciably deflect the path of the clubhead. The spring constant or flexibility of a standard stifness shaft of a Wilson driver was measured and found to be 1.0 inches deflection per pound of sidewise force on the clubhead when the grip was clamped in a vise. A mere half pound of lift or dive force on the clubhead is thus sufficient to deflect the clubhead by one-half an inch, more than enough to ruin the play.

To reduce aerodynamic forces on the clubhead, a multi-angular streamlined shape was developed, shaped to the limit of conformance to existing U.S.G.A. rules. As a result, turbulence behind the head is greatly reduced and von Karman vortex generation is weakened to the point of being negligible. In addition, the lift forces and dive forces (which I will hereafter refer to as 'lift' forces whether they be of positive or negative value) have been greatly reduced. Through this reduction, the clubhead follows a path essentially in the direction it was guided by the golfer. The transition then from an aerodynamic high wood such as a six or seven to a low iron is therefore much less abrupt. The casual golfer will thus find that his performance with a matched set of aerodynamic woods is more consistent that it has been with previously designed and shaped sets of clubs.

Figure 1:
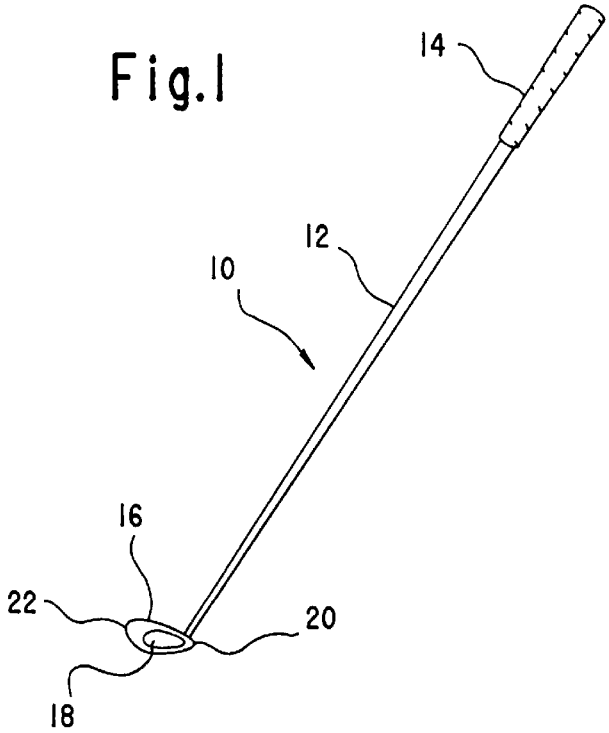
FIG. 1 is a side elevational view of a golf club.
Figure 3:
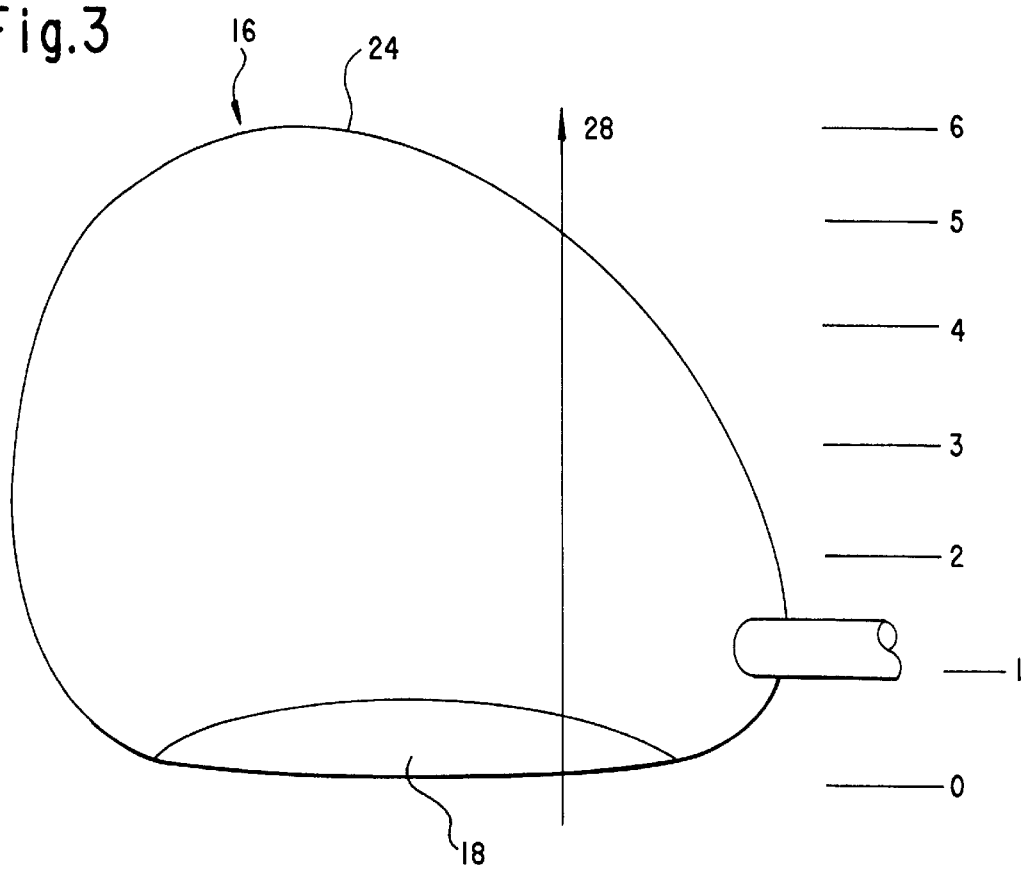
FIG. 3 is an elevational view of the head of a golf club.
Figure 4:
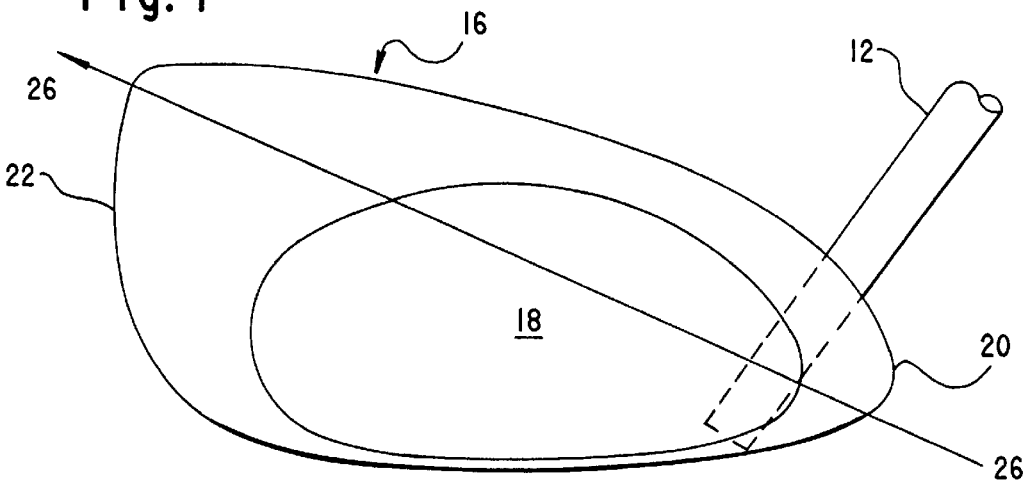
FIG. 4 is a front elevational view of the clubhead of FIG. 3.

Turning now to the drawing figures, FIG. 1 illustrates a golf club 10 known as a wood. The club consists of three basic elements, a shaft 12, a handgrip 14 at one end of the shaft, and a clubhead 16 at the other end of the shaft. Clubhead 16 has a face 18 which is the portion of the club that is designed for striking a ball, a heel 20, and a toe 22. FIG. 3 illustrates the clubhead as seen from above and FIG. 4 shows the clubhead as it might be viewed by a ball just prior to being impacted by the club. FIG. 4 also illustrates the direction of airflow 26 over the clubhead at a point in a typical golfer's swing, approximately 90 degrees of swing prior to impact with the ball while FIG. 3 illustrates the normal airflow 28 over the clubhead near or at the moment of impact with a ball. In FIG. 3 are shown a face 18 and back 24.

Note that the direction of airflow swings around by approximately 90 degrees during this final portion of the golf swing. For this reason, the design of a golf club can be improved by using a profile that is suitably streamlining over this whole angular range of airflow direction, with however, an emphasis on the final direction 28 wherein the flow is approximately normal to the face and front of the club.

Figure 2:
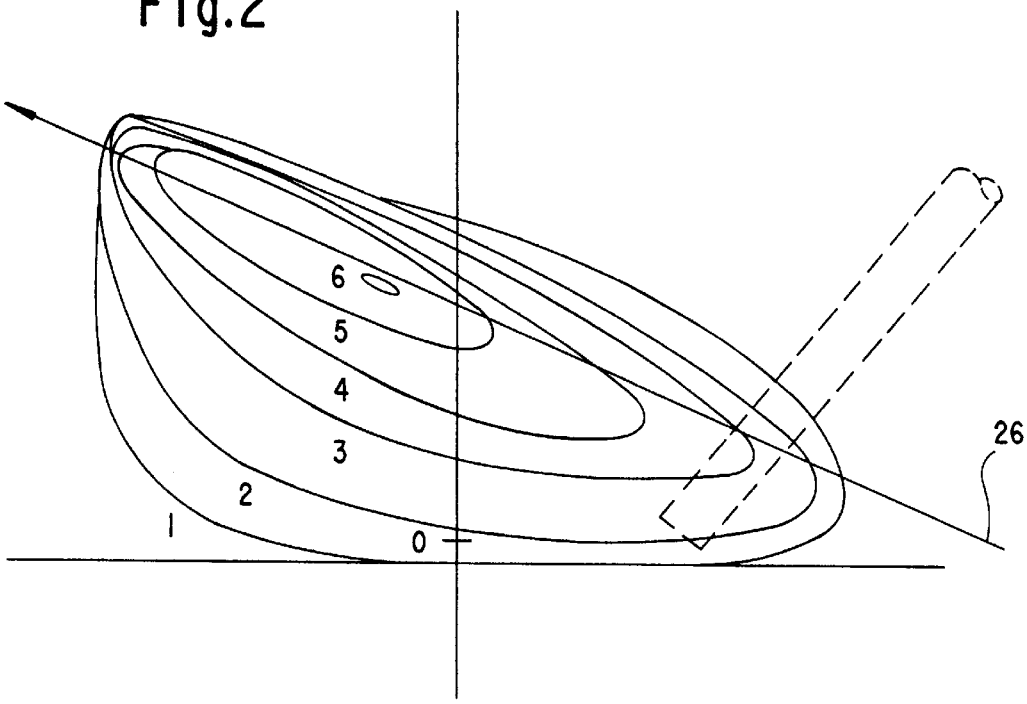
FIGS. 2 (*a* through *e*) is an overlay of sectional outlines of the sections indicated for the golf clubhead in FIG. 3.

Turning now to FIG. 2, aerodynamic outline profiles are given which match with the sectional lines 0 through 6 which are given in FIG. 3. Profiles 0 and 6 are included to show the approximate beginning and ending points of the clubhead. The airflow line 26 is also shown in FIG. 2 to illustrate to a person skilled in aerodynamics the streamlined shape which is achievable in a golf club.

FIG. 5 has been included for further clarification of the turning of a club shaft as a club is swung. The club shaft 12 is shown with clubhead 16 as it is swung through a final 90 degrees or so of angle 30*a*. Club swing angles have been arbitrarily divided off at angles 1, 2, 3, 4, and 5, 5 being the usual position of impact with a ball. Note that the 90 degrees chosen here purely is an arbitrary value and one could just as easily go back 120 or 150 degrees in the swing prior to club impact with a ball such as denoted by angle 32*a*. 90 degrees is however far enough back in the swing to illustrate the club rotation effect over which my aerodynamic clubhead operates. A pin 34 has been drawn in FIG. 5 to further illustrate the turning effect, and a wheel 36 to show that in this case a club rotation of roughly 90 degrees or so is performed during the last 90 degrees of club swing. With different golfers, this club rotation might be considerably more or less than 90 degrees, and in the case of one famous professional golfer, his club shaft rotated 135 degrees during the last 90 degrees of club swing. As shown by rotational arrow 38 and wheel arrow 40, the rotation of the club shaft is counterclockwise as viewed by the golfer when she or he swings the club from right to left.

In FIG. 6, a clubhead is shown from above to illustrate the general air flow direction denoted by arrow 26 across the club 16 at angle 1 in FIG. 5. Sectional lines are drawn at each side of the clubhead 16 to shown where profiles are taken to use in manufacturing a club to this shape. These profiles are given in FIGS. 7*a* through 7*h*. Profile 7*c* has the club shaft 12 overlaid to give the proper orientation of the profiles with respect to FIG. 6.

In FIG. 8, the same clubhead and profile as in FIG. 6 is shown, but in a different orientation as it will have at the moment of impact with a golf ball. Airflow at the moment of impact is across the clubhead in the direction of arrow 28. Cross sectional profiles for the clubhead in FIG. 8 are given in FIG. 9*a* through 9*g*. Overlaid on profile 9*e* is an arrow 28 to indicate the general direction of airflow over the clubhead, which arrow illustrates again the general streamlined shape which has been attained for this clubhead.

In FIG. 10, a graph is shown that gives measured rotation of the shaft of a club during a club swing by a professional golfer. Note that the club shaft rotates faster per unit angle of swing towards the end of the swing and moment of impact with the ball.

In FIGS. 11 and 12 an aerodynamically shaped clubhead is shown having a faceplate 40 which contains the striking area or face 18 of the club. Faceplate 40 is inset into the aerodynamically faired portion 42 of the clubhead. The line of inset 44 illustrates how the faceplate may be embedded so as to immovably fix it in place and seat it tightly against the fairing whereby at impact with a ball, the impact force on the faceplate is distributed over a large area of the fairing, thereby attaining a high coefficient of restitution for the clubhead even though it is made of a soft material such as wood.

In FIGS. 13 and 14, a faceplate 46 contains an integral connection means 48 for the club shaft 12. This serves the purpose of strengthening the junction between the shaft 12 and the clubhead 24, which is compromised in this head shape by the aerodynamic necessity to thin down the head in the region adjacent the heel 20.

In FIGS. 15 and 16, a preferred embodiment of the invention is illustrated wherein a faceplate 46 containing connection means 48 for junction with shaft 12 is fitted to aerodynamic fairing 42 along jointline 50. Shaping in this case provides for the jointline 50 to be flat and thereby economical in production cost. Fairing 42 may be hollowed out as illustrated by dashed line 52 to reduce mass or adjust the polar moment of inertia of the clubhead 16. Pockets 54 may be bored in fairing 42 to receive weights for adjustment of head weight by the golfer.

In FIG. 17, an alternate preferred embodiment of the invention is illustrated wherein faceplate 46 containing face 18 has an integral hozel 56 which may be necked down in a region 58 adjacent the aerodynamic surface 60 of the clubhead 16. This necking is believed to conform to U.S.G.A. rules. It can materially reduce air drag of the club shaft 12 and reduce the tendency of turbulence from the shaft to disturb flow of air past the clubhead.

While the two clubhead profiles given in FIG. 2 and FIGS. 7/9 are certainly not the only profiles which will perform in streamlined fashion as described, their general shape is believed to be new and unique in the field of golf. This is particularly true since they were derived to effect a compromise between flows which vary over an angle of approach of up to 135 degrees. All previous clubhead shapes appear to have been developed to achieve aerodynamic drag minimum and freedom from vortex formation for only one direction of airflow, namely straight back from the club face to the club back, which design neglects the actual motion of a clubhead through the air.

These streamline profiles are of course not the only profiles which will achieve a large reduction in aerodynamic drag on a swinging golf club. However, the spirit of this invention is that such streamlining must be multi-angular and that in addition it must be compromised or skewed to provide better streamlining at impact than it provides when the flow direction is at 135 degrees to that at impact. It is felt that all golf clubs so designed to be aerodynamically streamlined for flow angles that vary through an angular sweep of up to 135 degrees should be covered by this invention.

I claim:

1. A golf club comprising:

a shaft;

a grip connected to a first end of the shaft; and a head connected at a heel end to a second end of the shaft, the head including a face portion and a fairing portion behind the face portion, the fairing portion being tapered to a back end in a direction substantially perpendicular to the face portion, and in a direction substantially parallel to the face portion, the fairing portion smoothly extending from the heel end to a toe end;

wherein the fairing portion is shaped to include smooth oval shaped cross sections at the back end of the fairing portion, substantially parallel to the face portion, each oval shaped cross section extending from a heel point of the heel end to a toe point of the toe end.

2. The golf club of claim 1, wherein, for each cross section of the fairing portion substantially parallel to the face portion, a majority of an upper portion of each cross section is substantially flat.

3. The golf club of claim 1, wherein the fairing portion is shaped to aerodynamically shaped cross sections, substantially parallel to the face portion, each aerodynamically shaped cross section extending from a heel point of the heel end to a toe point of the toe end smoothly and continuously on both a top portion and a bottom portion of each cross section.

4. A golf club head comprising:

a face portion; and a fairing portion coupled to the face portion, the fairing portion being tapered to a back end in a direction substantially perpendicular to the face portion, and in a direction substantially parallel to the face portion, the fairing portion smoothly extending from a heel end to a toe end;

wherein the fairing portion is shaped to include smooth oval shaped cross sections at the back end of the fairing portion, substantially parallel to the face, each oval shaped cross section extending from a heel point of the heel end to a toe point of the toe end.

5. The golf club head as recited in claim 4, wherein, for each cross section of the fairing portion in a direction parallel to the face portion, a majority of an upper portion of each cross section is substantially flat.

* * * * *